US009704450B2

(12) United States Patent
Takani et al.

(10) Patent No.: US 9,704,450 B2
(45) Date of Patent: Jul. 11, 2017

(54) DRIVER IC FOR DISPLAY PANEL

(71) Applicant: Synaptics Japan GK, Tokyo (JP)

(72) Inventors: Toshiyuki Takani, Tokyo (JP); Toshikazu Tachibana, Tokyo (JP); Shinobu Notomi, Tokyo (JP); Takesada Akiba, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 58 days.

(21) Appl. No.: 14/194,706

(22) Filed: Mar. 1, 2014

(65) Prior Publication Data

US 2014/0267206 A1 Sep. 18, 2014

(30) Foreign Application Priority Data

Mar. 14, 2013 (JP) ..... 2013-051686

(51) Int. Cl.
*G09G 3/36* (2006.01)

(52) U.S. Cl.
CPC ..... *G09G 3/3688* (2013.01); *G09G 3/3614* (2013.01); *G09G 2310/0291* (2013.01); *G09G 2320/0247* (2013.01)

(58) Field of Classification Search
CPC .. G09G 3/3685–3/3688; G09G 3/3696; G09G 2310/0243–2310/0254; G09G 2300/0804; G09G 2310/027; G09G 2310/0297; G09G 3/3659; G09G 3/3666
See application file for complete search history.

(56) References Cited

U.S. PATENT DOCUMENTS 5,650,796 A * 7/1997 Owaki ..... G09G 3/3648 345/94
2005/0134546 A1* 6/2005 Woo ..... G09G 5/02 345/100
2008/0117235 A1 5/2008 Morita
2008/0191912 A1* 8/2008 Shin ..... H03M 1/667 341/122
2009/0009510 A1 1/2009 Shu et al.
(Continued)

FOREIGN PATENT DOCUMENTS

JP 2001-343942 A 12/2001
JP 2005-316188 A 11/2005
(Continued)

OTHER PUBLICATIONS

Office Action issued Dec. 15, 2016 for related Japanese Application No. 2013-051686.
(Continued)

*Primary Examiner* — Sanghyuk Park
(74) *Attorney, Agent, or Firm* — Miles & Stockbridge P.C.

(57) ABSTRACT

For each display line cycle, inputs to a pair of differential input terminals of a driving circuit are alternately switched in a cycle shorter than the display line cycle between a gradation voltage and a reference voltage. According to this, a chopping operation of switching polarities of offset appearing at the output of the driving circuit within one display line is performed for a plurality of times, and accordingly, a pixel of each display line maintains brightness information in which the chopping operation is already performed. As a result, although a frame cycle is lengthened, it is difficult to visually recognize a brightness difference caused by the offset.

13 Claims, 11 Drawing Sheets

(56) References Cited

U.S. PATENT DOCUMENTS

| | | | | |
|---|---|---|---|---|
| 2009/0303166 | A1* | 12/2009 | Tsubata | G09G 3/342 345/87 |
| 2013/0050146 | A1 | 2/2013 | Saitoh et al. | |
| 2014/0145921 | A1* | 5/2014 | Imai | G09G 3/3688 345/87 |

FOREIGN PATENT DOCUMENTS

| | | | |
|---|---|---|---|
| JP | 2008-129029 | A | 6/2008 |
| JP | 2009-014842 | A | 1/2009 |
| WO | 2011/145360 | A1 | 11/2011 |
| WO | 2013/021873 | A1 | 2/2013 |

OTHER PUBLICATIONS

Office Action dated Mar. 30, 2017 for related Japanese Application No. 2013-051686.

* cited by examiner

DRIVER IC FOR DISPLAY PANEL

CROSS-REFERENCE TO RELATED APPLICATIONS

The Present application claims priority from Japanese application JP 2013-051686 filed on Mar. 14, 2013, the content of which is hereby incorporated by reference into this application.

BACKGROUND

The present invention relates to a driver IC which operates a display panel, and particularly to a control technology of a driving circuit which drives a source line of a liquid crystal panel by a display line unit. For example, the present invention relates to a technology which can be effectively applied to driving of a low leakage liquid crystal panel.

If there is undesirable input offset in a differential amplification circuit which drives electrodes of a display panel, the offset appears at an output of the differential amplification circuit, thereby generating a flicker. In JP-A-2005-316188, there is a description with respect to a driving control method in which a signal supplied to an inverting input terminal and a non-inverting input terminal of the differential amplification circuit which drives electrodes of a flat panel configured from an organic EL is switched in a display frame cycle and a display line cycle, and thereby, an influence of an offset voltage between successive display lines of a display screen is eliminated. In short, a control (chopping control) which switches polarities of the offset appearing at the output of the differential amplification circuit due to unbalance of an input circuit characteristic of the differential amplification circuit which configures an output buffer for each display frame cycle or for each display line cycle, is performed, and thereby, the output of the differential amplification circuit is averaged with respect to time and a physical space.

SUMMARY

Low power consumption according to a high definition of a display panel is required, and an improvement in image quality is required. For example, a pixel of a liquid crystal display panel stores a brightness voltage applied from a source electrode thereof through a thin film transistor (TFT) element, in a storage capacitor of a liquid crystal element, and thereby a direction of the liquid crystal element is determined. The brightness voltage is applied to the pixel for each frame cycle, and thereby, electronic charge information (brightness information) is rewritten. Thus, if a frame frequency is lowered for the purpose of the low power consumption, pixel data cannot be maintained due to panel leakage, and the image quality is degraded. For example, the panel leakage occurs due to a substrate leakage of the TFT element or the like. These days, as practical application of a low leakage panel in which such a panel leakage is suppressed, a display panel which uses the TFT element formed by a transparent oxide semiconductor configured from, for example, indium, gallium, zinc, and oxygen, is in progress.

In a case where such a low leakage panel is used, lengthening the frame cycle is advisable from the viewpoint of the low power consumption in a display of a still image.

However, the present inventor has found that if the frame cycle was lengthened by using the above-described low leakage panel, a period when the offset polarities were switched and maintained in order to cancel the offset was lengthened, and it was easy to visually recognize the brightness difference for each polarity switching. As a result, the image quality was degraded. That is, if the offset polarities are switched for each display line cycle, the period when the brightness information rewritten for each display line cycle is maintained is lengthened in case that the frame cycle is lengthened, and thereby it is easy to visually recognize the brightness difference that occurred by the offset difference for each polarity switching by a display line unit. As the result, the image quality is degraded.

The object of the present invention is to provide a driver IC which can prevent the image quality degradation caused by the offset of the driving circuit, although the display frame frequency is lowered.

The above-described object, other objects and novel features will become apparent from the description of the present specification and the accompanying drawings.

An outline of a representative embodiment out of the embodiments disclosed in the present application, will be briefly described as follows.

That is, for each display line cycle, the inputs to a pair of the differential input terminals of the driving circuit are alternately switched in the cycle shorter than the display line cycle between the gradation voltage and the reference voltage.

According to this, the chopping operation of switching the polarities of the offset appearing at the output of the driving circuit within one display line is performed for a plurality of times, and accordingly, the pixel of each display line maintains the brightness information in which the chopping operation is already performed. As the result, although the frame cycle is lengthened, it is difficult to visually recognize the brightness difference caused by the offset.

An advantage obtained by the representative embodiment out of the embodiments disclosed in the present application, will be briefly described as follows.

That is, although the frequency of the display frame is lowered, it is possible to prevent the image quality degradation caused by the offset of the driving circuit from occurring.

DETAILED DESCRIPTION

1. Summary of the Embodiments

Figure 1:
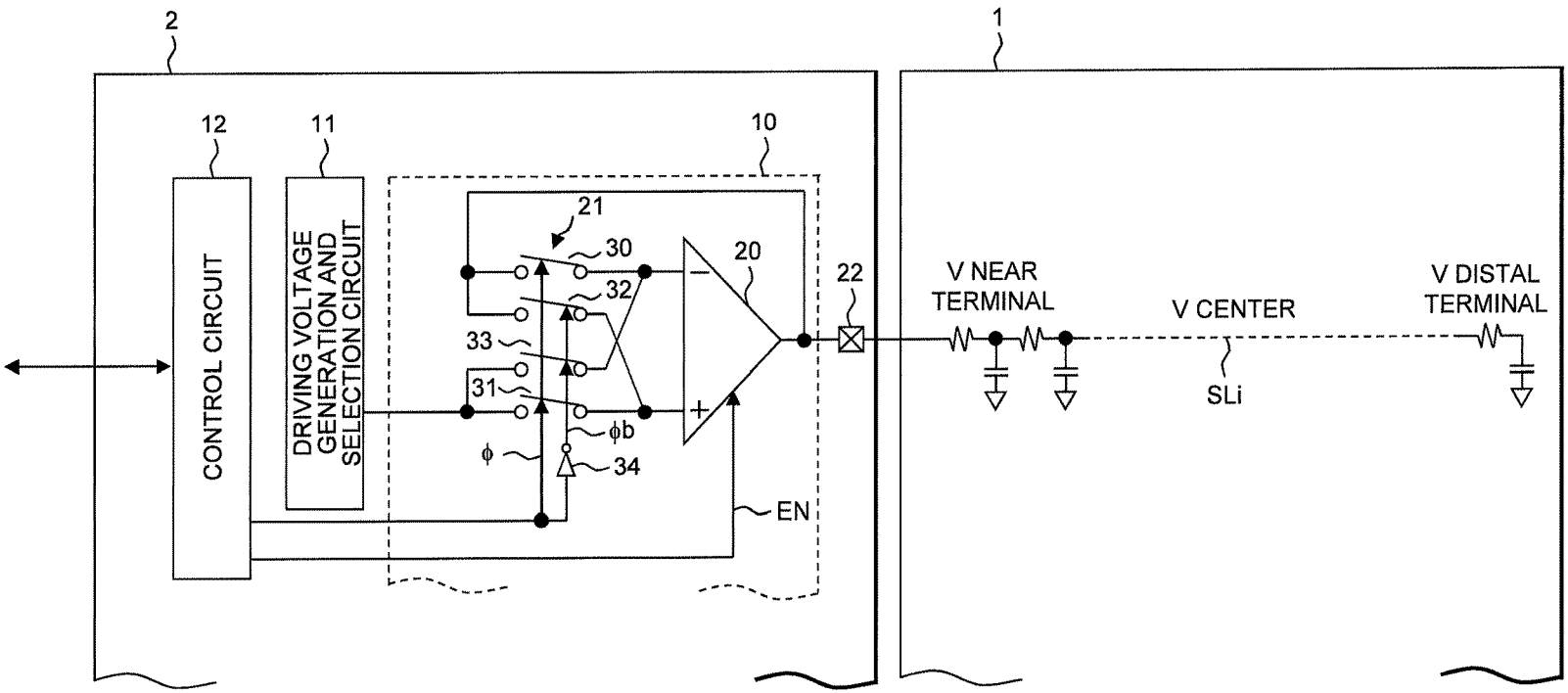
FIG. 1 is a block diagram exemplarily illustrating a configuration of performing a chopping operation of a source electrode line.

First, summary of representative embodiments of the invention disclosed in the application will be described. Reference numerals in drawings in parentheses referred to in description of the summary of the representative embodiments just denote components included in the concept of the components to which the reference numerals are designated.

(1) <Alternately Switching Differential Inputs of Driving Circuit in Cycle Shorter than Display Line Cycle>

A driver IC (2 or 2A) which includes a driving circuit 10 or 10A for driving a display panel (1) alternately switches inputs to a pair of differential input terminals of the driving circuit for a plurality of times between a gradation voltage and a reference voltage, for each display line cycle which is a switching cycle of the display line during a display period.

According to this, an operation of alternately switching differential inputs applied to the driving circuit within one display line, that is, an operation of switching polarities of an offset appearing at an output of the driving circuit due to unbalance of the differential input characteristic of the driving circuit, is performed for a plurality of times, and accordingly, a signal line leading to a pixel from each display line converges to a voltage in which an influence of the offset is eliminated by the plurality of switching operations of the differential inputs. As a suitable example, a frequency for alternately switching the differential inputs is a frequency higher than a time constant of the signal line which is driven by the driving circuit. As a result, the pixel can maintain brightness information in which the influence of the offset is already cancelled or reduced within the display line. That is, the pixel does not reduce influence of the offset occurring between the display lines, but can maintain the brightness information in which the influence of the offset is already cancelled or reduced within the display line. Thus, although a frame cycle is lengthened, it is difficult for a brightness difference caused by the offset to be visually recognized, and although the frequency of a display frame is decreased, it is possible to prevent image quality degradation caused by the offset of the driving circuit from occurring.

(2) <Floating Output Terminal of Driving Circuit Before End of Gate Selection Period>

In section (1), after ending the alternate switching operation for each display line cycle, the driver IC ends a selection of the pixel of the display line by floating the output terminal of the driving circuit.

According to this, as a chopping waveform on the signal line of the display panel which is driven by the driving circuit by alternately switching the differential inputs drifts apart from the driving circuit, a change of the chopping waveform becomes slow. By floating the output terminal of the driving circuit, a difference between a near terminal and a distal terminal of the signal line is averaged by a charge share of distributed capacitances of the signal line, and in the full range from the near terminal to the distal terminal of the signal line, convergence of the offset becomes uniform and converging of the offset also becomes faster. In addition, ending the selection of the pixel of the display line by performing the floating is to guarantee that the pixel can maintain the brightness information charge-shared by the floating.

(3) <Alternately Switching Polarities of Differential Inputs Applied to Driving Circuit from the Beginning for Each Display Line>

In section (2), the driver IC switches the differential input terminals through which the gradation voltage and a reference voltage are applied to the driving circuit from the beginning, for each display line cycle.

According to this, the polarities of the differential inputs applied to the driving circuit from the beginning for each display line are alternately switched for each display line, and thereby, the polarities of the offset are not concentrated to one side, and even in this regard, it is possible to contribute to the improvement of an image display quality.

(4) <A Plurality of Switching of Polarities of Offset Appearing at Output of Driving Circuit within One Display Line>

The driver IC (2 or 2A) which drives the display panel (1) includes a voltage generation and selection circuit (11) which generates a plurality of gradation voltages and selects a gradation voltage used for a display among the plurality of gradation voltages for each display line, the driving circuit (10 or 10A) which outputs a driving voltage by inputting the reference voltage and the gradation voltage selected by the voltage generation and selection circuit to the differential input terminals, and a control circuit (12) which controls an output operation of the driving circuit. The control circuit divides one display frame into a display driving period and a non-display driving period, and performs a control which stops driving of the driving circuit during the non-display driving period, and causes the driving circuit to output a driving voltage used for the display for each display line cycle which is a switching cycle of the display line during the display driving period. At this time, the chopping operation of switching the polarities of the offset appearing at the output of the driving circuit within the display line cycle is performed for a plurality of times.

According to this, the chopping operation of switching the polarities of the offset appearing at the output of the driving circuit within the one display line is performed for a plurality of times, and accordingly, the signal line leading to the pixel from each display line converges to a voltage in which an influence of the offset is eliminated by the plurality of chopping operations. As a result, the pixel can maintain brightness information in which the influence of the offset is already eliminated or reduced within the display line. That is, the pixel does not reduce the influence of the offset occurring between the display lines, but can maintain the brightness information in which the offset is already cancelled or reduced within the display line. Thus, although a frame cycle is lengthened, it is difficult for a brightness difference caused by the offset to be visually recognized, and although the frequency of a display frame is lowered, it is possible to prevent an image quality degradation caused by the offset of the driving circuit from occurring.

(5) <Alternately Switching Differential Input of Driving Circuit in Cycle Shorter than Display Line Cycle>

In section (4), the chopping operation is a control which alternately switches the inputs to a pair of the differential input terminals of the driving circuit, in the cycle shorter than the display line cycle between the gradation voltage and the reference voltage.

According to this, it is possible to easily realize the chopping operation.

(6) <Floating Output Terminal of Driving Circuit Before End of Gate Selection Period>

In section (5), the control circuit performs the control which ends the gate selection by floating the output terminal of the driving circuit, for each display line cycle, after ending the alternate switching operation.

According to this, as the chopping waveform on the signal line of the display panel which is driven by the driving circuit by alternately switching the differential inputs drifts apart from the driving circuit, the change of the chopping waveform becomes slow. By floating the output terminal of the driving circuit, the difference between the near terminal and the distal terminal of the signal line is averaged by the charge share of the distributed capacitances of the signal line, and in the full range from the near terminal to the distal terminal of the signal line, the convergence of the offset becomes uniform and the converging of the offset also becomes faster. In addition, ending the selection of the pixel of the display line by performing the floating is to guarantee that the pixel can maintain the brightness information charge-shared by the floating.

(7) <Alternately Switching Polarities of Differential Inputs Applied to Driving Circuit from the Beginning for Each Display Line>

In section (5), the control circuit performs the control which switches the differential input terminals through which the gradation voltage and the reference voltage are applied to the driving circuit from the beginning, for each display line cycle.

According to this, the polarities of the differential inputs applied to the driving circuit from the beginning for each display line are alternately switched for each display line, and thereby, the polarities of the offset are not concentrated to one side, and even in this regard, it is possible to contribute to the improvement of the image display quality.

(8) <Making Output of Driving Circuit to be High Impedance>

In section (6), the control which floats the output terminal is a control which makes the output of the driving circuit to be a high impedance.

According to this, it is possible to easily realize the floating of the output terminal.

(9) <Cutting Off Switch Between Output of Driving Circuit and Output Terminal>

In section (6), the control which floats the output terminal is a control which cuts off a transmission gate (40) between the output of the driving circuit and the output terminal.

According to this, it is possible to easily realize the floating of the output terminal.

(10) <Buffer Amplifier and Switching Switch>

In section (5), the driving circuit includes a buffer amplifier configured from an operational amplifier (20) which has the differential input terminals, and a switch circuit (21) which alternately switches the gradation voltage and the reference voltage which are supplied to the differential input terminals.

According to this, it is possible to easily realize the chopping operation using a switch control of the switch circuit.

(11) <Voltage Follower Amplifier and Switching Switch>

In section (10), the buffer amplifier has an inverting input terminal and a non-inverting input terminal as the differential input terminals, and is a voltage follower amplifier in which a feedback signal of an output is set as a reference signal. The switch circuit is a switch circuit which alternately switches a signal supplied to the inverting input terminal and a signal supplied to the non-inverting input terminal between the feedback signal and the gradation voltage.

According to this, it is possible to easily realize the chopping operation with respect to the voltage follower amplifier.

(12) <Alternately Switching Differential Input of Driving Circuit in Cycle Shorter than Display Line Cycle>

The driver IC which drives the display panel floats the output terminal of the driving circuit, for each display line cycle which is the switching cycle of the display line during the display period, before ending the selection of the pixel of the display line.

According to this, as the output terminal of the driving circuit is floated, a driving waveform on the signal line of the display panel which is driven by the driving circuit by alternately switching the differential inputs is averaged by a charge share of the distributed capacitances of the signal line, and in the full range from the near terminal to the distal terminal of the signal line, the driving waveform converges in a high speed toward a voltage in which an influence of the offset is eliminated. Ending the selection of the pixel of the display line by performing the floating is to guarantee that the pixel can maintain the brightness information charge-shared by the floating.

(13) <Alternately Switching Polarities of Differential Inputs Applied to Driving Circuit from the Beginning for Each Display Line>

In section (12), the driver IC switches the differential input terminals through which the gradation voltage and the reference voltage are applied to the driving circuit from the beginning, for each display line cycle.

According to this, the polarities of the differential inputs applied to the driving circuit from the beginning for each display line are alternately switched for each display line, and thereby, the polarities of the offset are not concentrated to one side, and even in this regard, it is possible to contribute to the improvement of an image display quality.

(14) <Alternately Switching Differential Input of Driving Circuit in Cycle Shorter than Display Line Cycle>

The driver IC (2 or 2A) which operates the display panel includes a voltage generation and selection circuit (11) which generates a plurality of gradation voltages and selects a gradation voltage used for a display among the plurality of gradation voltages for each display line, the driving circuit (10 or 10A) which outputs a driving voltage by inputting the reference voltage and the gradation voltage selected by the voltage generation and selection circuit to the differential input terminals, and a control circuit (12) which controls an output operation of the driving circuit. The control circuit divides one display frame into a display driving period and a non-display driving period, and performs a control which stops driving of the driving circuit during the non-display driving period, and causes the driving voltage used for the display to be output by switching the polarities of the offset appearing at the output of the driving circuit, for each display line cycle which is a switching cycle of the display line during the display driving period. At this time, for each display line cycle, the polarities of the offset are switched, and thereafter, the control circuit ends the selection of the pixel of the display line by floating the output terminal of the driving circuit.

According to this, as the driving waveform on the signal line of the display panel which is driven by the driving circuit by switching the polarities of the offset for each display line cycle drifts apart from the driving circuit, a change of the driving waveform becomes slow. By floating the output terminal of the driving circuit, the difference between the near terminal and the distal terminal of the signal line is expedited so as to be averaged by the charge share of the distributed capacitances of the signal line, and in the full range from the near terminal to the distal terminal of the signal line, a converging offset effect can be obtained. In addition, ending the selection of the pixel of the display line by performing the floating is to guarantee that the pixel can maintain the brightness information charge-shared by the floating.

(15) <Alternately Switching Polarities of Differential Inputs Applied to Driving Circuit from the Beginning for Each Display Line>

In section (14), the control circuit performs the control which switches the differential input terminals through which the gradation voltage and the reference voltage are applied to the driving circuit from the beginning, for each display line cycle.

According to this, the polarities of the differential inputs applied to the driving circuit from the beginning for each display line are alternately switched by a display frame unit, and thereby, the polarities of the offset are not concentrated to one side, and even in this regard, it is possible to contribute to the improvement of the image display quality.

(16) <Making Output of Driving Circuit to be High Impedance>

In section (14), the control which floats the output terminal is a control which makes the output of the driving circuit to be a high impedance.

According to this, it is possible to easily realize the floating of the output terminal.

(17) <Cutting Off Switch Between Output of Driving Circuit and Output Terminal>

In section (16), the control which floats the output terminal is a control which cuts off the transmission gate (40) between the output of the driving circuit and the output terminal.

According to this, it is possible to easily realize the floating of the output terminal.

2. Further Detailed Description of the Embodiments

The embodiments will be described in further detail.

<<Display Device>>

Figure 2:
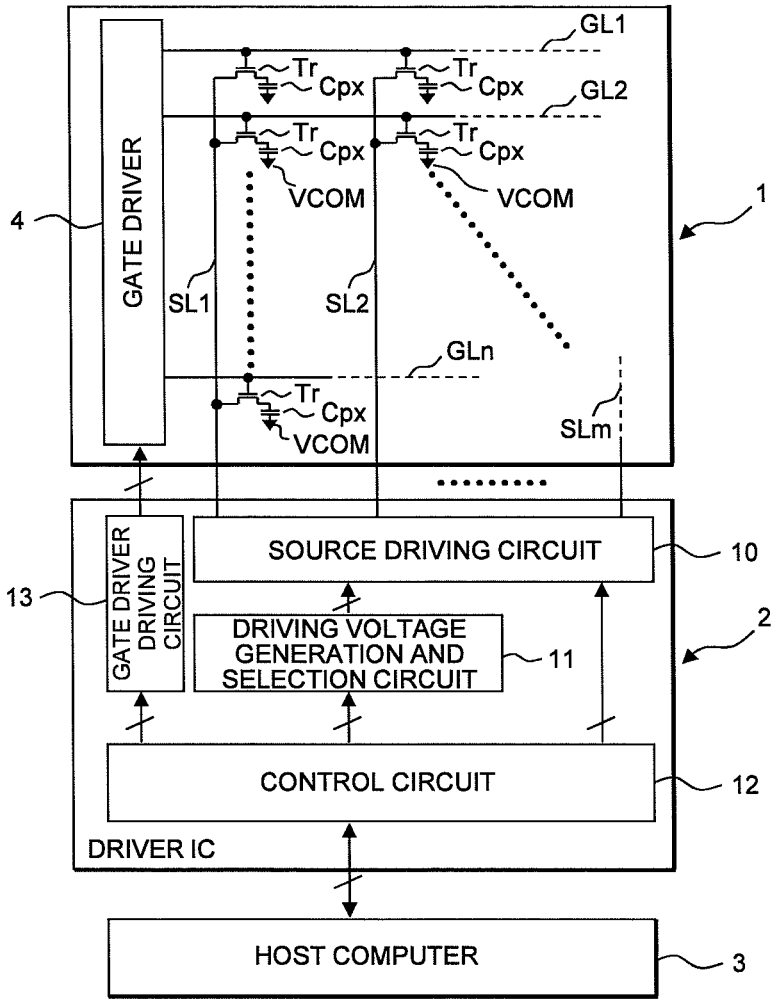
FIG. 2 is a block diagram exemplarily illustrating a display device which includes a display panel and a driver IC driving the display panel.

In FIG. 2, a display device which includes the display panel 1 and the driver IC 2 driving the display panel is exemplarily illustrated. The display panel 1 is configured by, for example, a liquid crystal display panel. For example, the display panel 1 includes a TFT array substrate in which thin film transistors Tr called TFT are formed in a matrix on a glass substrate, and gate electrode lines GL1 to GLn (n is a positive integer) connected to gate electrodes thereof and source electrode lines SL1 to SLm (m is a positive integer) connected to source electrodes thereof are formed to intersect with each other. The display panel 1 is configured to have the TFT array substrate on which a liquid crystal layer, a common electrode layer with respect to a pixel electrode, a color filter, a surface glass, and the like are stacked. Each pixel is formed to have a liquid crystal element and a storage capacitor (in the figure, the liquid crystal element and the storage capacitor are denoted by one capacitor Cpx) which are a sub-pixel and connected to both a drain of the thin film transistor Tr and a common electrode VCOM. The Cpx is referred to as a pixel capacitor in the present specification. A line of a pixel along each of the gate electrode lines GL1 to GLn is referred to as a display line. In a display control, the gate electrode lines GL1 to GLn are sequentially driven, the thin film transistor Tr is turned on by a gate electrode line unit, and thereby, brightness signals are applied to the pixel capacitors Cpx from the source electrode lines SL1 to SLm through the thin film transistors Tr. As the result, electronic charge information (brightness information) according to the brightness signal is stored in the pixel capacitor Cpx, and thus, a liquid crystal state is controlled. The electronic charge information which is maintained by being written into the pixel capacitors Cpx by a display line unit through the source electrode lines SL1 to SLm, is rewritten by a display frame cycle unit.

Here, the display panel 1 is configured by a so-called low leakage panel. For example, the thin film transistor Tr is configured by a transparent oxide semiconductor which is composed of indium, gallium, zinc, and oxygen, and enables a frame frequency thereof to be a very low speed such as 1 Hz with respect to a still image. Thus, it is possible to decrease the amount of image data writing into the pixel by lengthening the frame cycle with respect to the still image display, and thus, the low power consumption is realized.

Although not particularly limited, driving of the gate electrode lines GL1 to GLn is performed by a gate driver 4 mounted in the display panel 1. The driver IC 2 performs driving of the source electrode lines SL1 to SLm, and a driving control of the gate driver 4 in synchronization with the driving of the source electrode lines. For example, the driver IC 2 is connected to a host computer 3 of an information terminal device such as a smart phone which uses the display panel 1 as a user interface, and an input and output of an operation command, display data, and the like is performed between the driver IC 2 and the host computer 3.

<<Driver IC>>

Although not particularly limited, the driver IC 2 is formed into a semiconductor integrated circuit, formed in a semiconductor substrate such as single crystal silicon using a CMOS integrated circuit fabrication technology, and incorporated in a TFT substrate of the display panel 1 in a shape such as a Chip On Glass (COG). Although not particularly limited, the driver IC 2 includes a source driving circuit 10, a driving voltage generation and selection circuit 11, a control circuit 12, and a gate driver driving circuit 13.

The source driving circuit 10 drives the source electrode lines SL1 to SLm in synchronization with a frame synchronization signal such as a vertical synchronization signal.

The gate driver driving circuit 13 applies driving timing signals GC1 to GCn or the like which drive the gate electrode lines GL1 to GLn to the gate driver 4. The driving timing signals GC1 to GCn are sequentially activated in synchronization with the display line cycle which is the driving cycle for each display line during the display period. The gate driver driving circuit 13 drives the gate electrode lines GL1 to GLn one by one to a selected level according to the driving timing signals GC1 to GCn by sequentially performing the switching for each display line cycle during the display period.

The source driving circuit 10 drives the source electrode lines SL1 to SLm using a gradation voltage of a corresponding display line for each display line cycle.

The driving voltage generation and selection circuit 11 generates a plurality of gradation voltages according to the number of display gradations, and selects a gradation voltage corresponding to each of the source electrode lines SL1 to SLm according to the display data from the plurality of gradation voltages. The selected gradation voltage is applied to the source driving circuit 10.

The control circuit 12 generates the display line cycle based on the frame cycle which is the switching cycle of the display frame, and in synchronization with the display line cycle, controls a timing generation operation of the gate driver driving circuit 13, a gradation voltage selection operation performed by the driving voltage generation and selection circuit 11, and the driving of the source electrode lines SL1 to SLm performed by the source driving circuit 10. For example, the frame cycle is defined by the frame synchronization signal such as the vertical synchronization signal, and the display line cycle is defined by a synchronization signal such as a horizontal synchronization signal. The control circuit 12 performs the display control which sets the frame frequency to, for example, 60 Hz, in case that a moving image display is instructed from the host computer 3, and sets the frame frequency to, for example, 1 Hz, in case that a still image display is instructed from the host computer 3. It is preferable that the display line cycle in the still image display be the same as that in the moving image display in terms of visual recognition of the still image. In this case, the frame cycle is divided into the display driving period and the non-display driving period, the gate electrode lines GL1 to GLn and the source electrode lines SL1 to SLm are driven during the display driving period, and as a result, the brightness information written to the pixel capacitor Cpx in each pixel is maintained during the non-display driving period. If the frame cycle is lengthened, it is easy to visually recognize the brightness difference for each polarity switching of the offset, only by simply performing the chopping operation of switching the polarities of an undesirable offset (offset voltage) appearing at the output of the buffer amplifier due to unbalance of a differential input characteristic of the buffer amplifier of the source driving circuit 10. As a countermeasure, a chopping operation of switching the polarities of the offset appearing at the output of the source driving circuit 10 for each display line cycle for a plurality of times, or a chopping operation of alternately switching the inputs to the differential input terminals of the source driving circuit 10 for each display line cycle for a plurality of times between the gradation voltage and the reference voltage is employed in the driver IC 2. Hereinafter, a specific example with respect to the chopping operation will be described.

<<Chopping Operation>>

In FIG. 1, the configuration of performing the chopping operation of the source electrode lines is exemplarily illustrated. Here, the configuration corresponding to one source electrode line SLi is representatively illustrated.

The source driving circuit 10 can alternately switch the gradation voltage and the reference voltage which are supplied to the differential input terminals of the operational amplifier 20 having the inverting input terminal (−) and the non-inverting input terminal (+) as the differential input terminals, using the switch circuit 21. Specifically, the operational amplifier 20 configures the voltage follower amplifier which is an example of the buffer amplifier through the switch circuit 21. The output of the operational amplifier 20 is connected to the output terminal 22. The switch circuit 21 includes switches 30 and 31 which are in an ON state in case that a switch signal ϕ is in a high level and in an OFF state in case that the switch signal ϕ is in a low level, and switches 32 and 33 which are in the ON state in case that a switch signal ϕb is in the high level and in the OFF state in case that the switch signal ϕb is in the low level. The switch signal ϕb is an inversion signal in which the switch signal ϕ is inverted by an inverter 34. The output of the operational amplifier 20 is fed back to the inverting input terminal (−) of the operational amplifier 20 through the switch 30, or fed back to the non-inverting input terminal (+) of the operational amplifier 20 through the switch 32 as the reference voltage. The gradation voltage output from the driving voltage generation and selection circuit 11 is supplied to the inverting input terminal (−) of the operational amplifier 20 through the switch 33, or supplied to the non-inverting input terminal (+) of the operational amplifier 20 through the switch 31. Accordingly, in case that the switch signal ϕ is in the high level (the switch signal ϕb is in the low level), the gradation voltage is supplied to the non-inverting input terminal (+), and the reference voltage is fed back to the inverting input terminal (−). On the other hand, in case that the switch signal ϕ is in the low level (the switch signal ϕb is in the high level), the gradation voltage is supplied to the inverting input terminal (−), and the reference voltage is fed back to the non-inverting input terminal (+). Thus, in case that there is an undesirable unbalance in the characteristic of each input circuit of the inverting input terminal (−) and the non-inverting input terminal (+) of the operational amplifier 20, the polarities of the offset appearing at the output of the operational amplifier 20 are switched by the switch signal ϕ being in the high level or being in the low level. For example, in a case where the output of the operational amplifier 20 has the offset of −Voffset in case that the switch signal ϕ is in the high level, the output of the operational amplifier 20 has the offset of +Voffset in case that the switch signal ϕ is in the low level. If the frequency of a clock change of the switch signal ϕ is higher than the display line frequency of switching the display line, the offset of −Voffset and the offset of +Voffset in the output of the operational amplifier 20 converge to be averaged by a chopping operation. Preferably, a convergence effect is ideal, if the frequency of the clock change of the switch signal ϕ is equal to or greater than a time constant of the corresponding source electrode line SLi. For example, in case that the display line frequency is k×60 Hz (k is the number of the display lines of one frame), the frequency of the clock change of the switch signal ϕ may be determined in the range of 100 KHz to 1 MHz.

The operational amplifier 20 can perform an amplification operation in case that an enable signal EN is in the high level, and stops the amplification operation in case that the enable signal EN is in the low level. In case that stopping the amplification operation, the output of the operational amplifier 20 is in a high impedance state.

The control circuit 12 performs the chopping operation by generating the switch signal ϕ and the enable signal EN. For example, as control aspects of the chopping operation, a first chopping control aspect to a third chopping control aspect will be described as follows. It is possible to employ a certain chopping control aspect which is determined in advance, in the control circuit 12. Alternatively, according to register setting or a command instruction from the host computer 3, or according to mode setting performed by an external terminal, the control circuit 12 may select one chopping control aspect.

<<First Chopping Control Aspect>>

Figure 3:
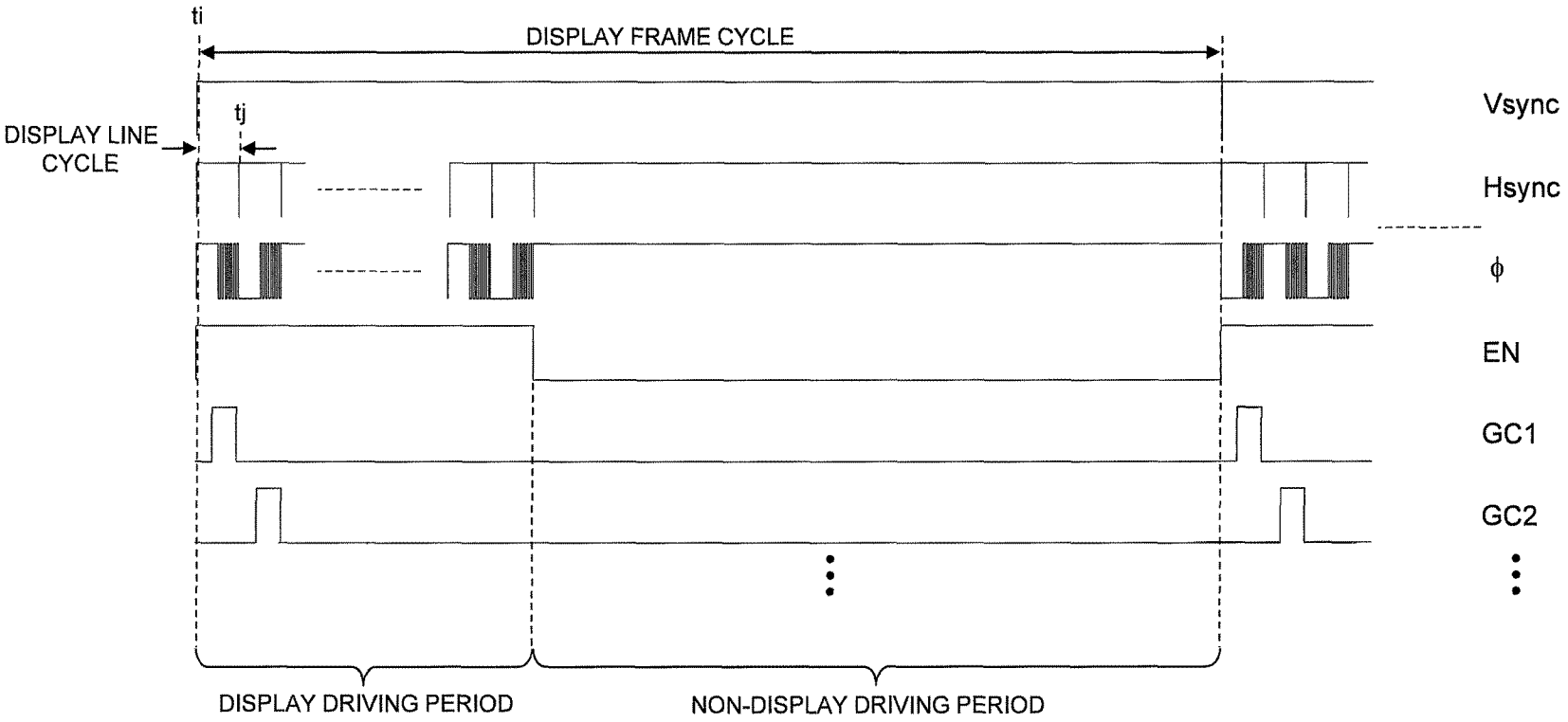
FIG. 3 is a timing diagram illustrating, in relation to a frame cycle, driving timing of a source electrode line according to a first chopping control aspect.
Figure 4:
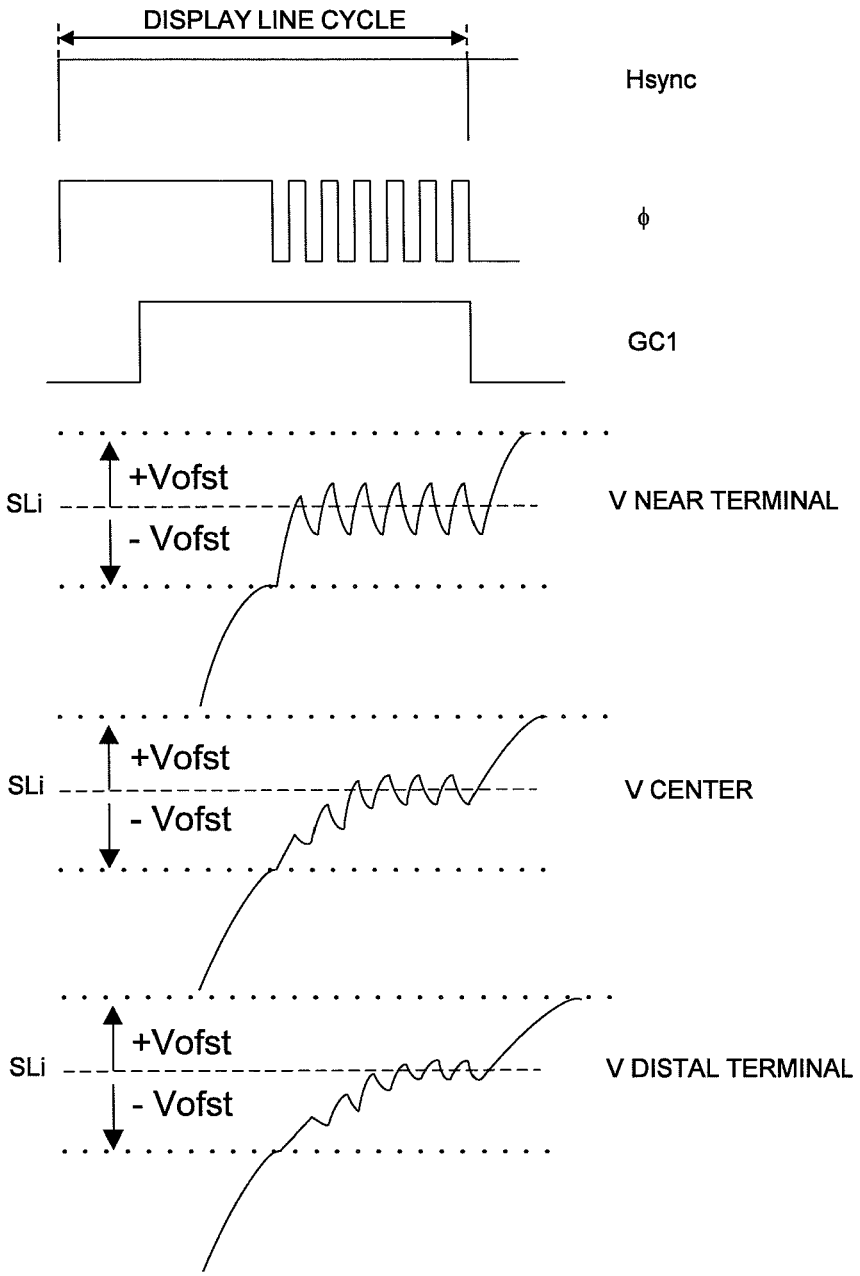
FIG. 4 is a waveform diagram illustrating, in relation to a display line cycle, driving timing and driving waveforms of a source electrode line according to a first chopping control aspect.

In FIG. 3, driving timing of the source electrode line according to the first chopping control aspect is illustrated in relation to the frame cycle. In FIG. 4, the driving timing and driving waveforms of the source electrode line according to the first chopping control aspect are illustrated in relation to the display line cycle.

In FIG. 3, Vsync is the vertical synchronization signal as the frame cycle signal, and Hsync is the horizontal synchronization signal defining the display line cycle. Here, a front porch and a back porch are ignored for convenience.

The control circuit 12 divides one display frame into the display driving period and the non-display driving period, and performs a control which stops the driving of the source electrode line SL1 to SLm performed by the source driving circuit 10, by making the enable signal EN to be in the low level during the non-display driving period. The control circuit 12 performs a control which causes the gate driver driving circuit 13 to sequentially activate the driving timing signals GC1 to GCn and causes the source driving circuit 10 to output the gradation voltage which is the driving voltage for display, in synchronization with the display line cycle which is the switching cycle of the display line during the display driving period. Although not particularly limited, in this case the frame cycle is set to 1 Hz, and the display line cycle during the display driving period is set to k×60 Hz.

During the display driving period, in case that the gradation voltage is output from the source driving circuit 10 to the source electrode lines SL1 to SLm for each display line cycle, the chopping operation is performed in which the switch signal ϕ is clock-changed by the frequency higher than the display line cycle, for example, a predetermined frequency in a range of 100 KHz to 1 MHz, and the polarities of the offset appearing at the output of the source driving circuit 10 within the display line cycle is switched.

According to the first chopping control aspect, the chopping operation of switching the polarities of the offset appearing at the output of the source driving circuit 10 within the one display line is performed for a plurality of times, and accordingly, the potentials of the source electrode line SL1 to SLm leading to the pixels from each display line converges to a voltage in which the offset is cancelled by the plurality of chopping operations. As a result, the pixel capacitor Cpx can maintain brightness information in which the influence of the offset is already eliminated or reduced within the display line. That is, the pixel does not reduce the influence of the offset occurring between the display lines, but can maintain the brightness information in which the offset is already cancelled or reduced within the display line. Thus, although a frame cycle is lengthened, it is difficult for a brightness difference caused by the offset of the source driving circuit 10 to be visually recognized, and although the frequency of a display frame is lowered to a frequency such as 1 Hz, it is possible to prevent image quality degradation caused by the offset of the source driving circuit 10 from occurring.

In addition, as illustrated in FIG. 3, the control circuit 12 performs the control which switches for each display line the differential input terminals through which the gradation voltage and the reference voltage are applied to the driving circuit from the beginning, for each display line cycle. For example, in the display line cycle starting from a time ti in FIG. 3, the switch signal ϕ starts from the high level. In contrast, in the next display line cycle starting from a time tj in FIG. 3, the switch signal ϕ starts from the low level. In this way, the polarities of the differential inputs applied from the beginning, in case that the operation of alternately switching the differential inputs for each display line is performed, are alternately switched by a display line unit, and thereby, the polarities of the offset are not concentrated to one side, and even in this regard, it is possible to contribute to the improvement of the image display quality.

As illustrated in FIG. 4, in the first chopping control aspect, as the chopping waveform on the source electrode line SLi of the display panel 1 which is driven by the source driving circuit 10 by alternately switching the differential inputs of the source driving circuit 10 drifts apart from the source driving circuit 10, the change of the chopping waveform becomes slow. Thus, a difference in the convergence of the offset occurs in the near terminal and the distal terminal of the source electrode line SLi, and there are concerns that the difference results in much difference in an image quality.

<<Second Chopping Control Aspect>>

Figure 5:
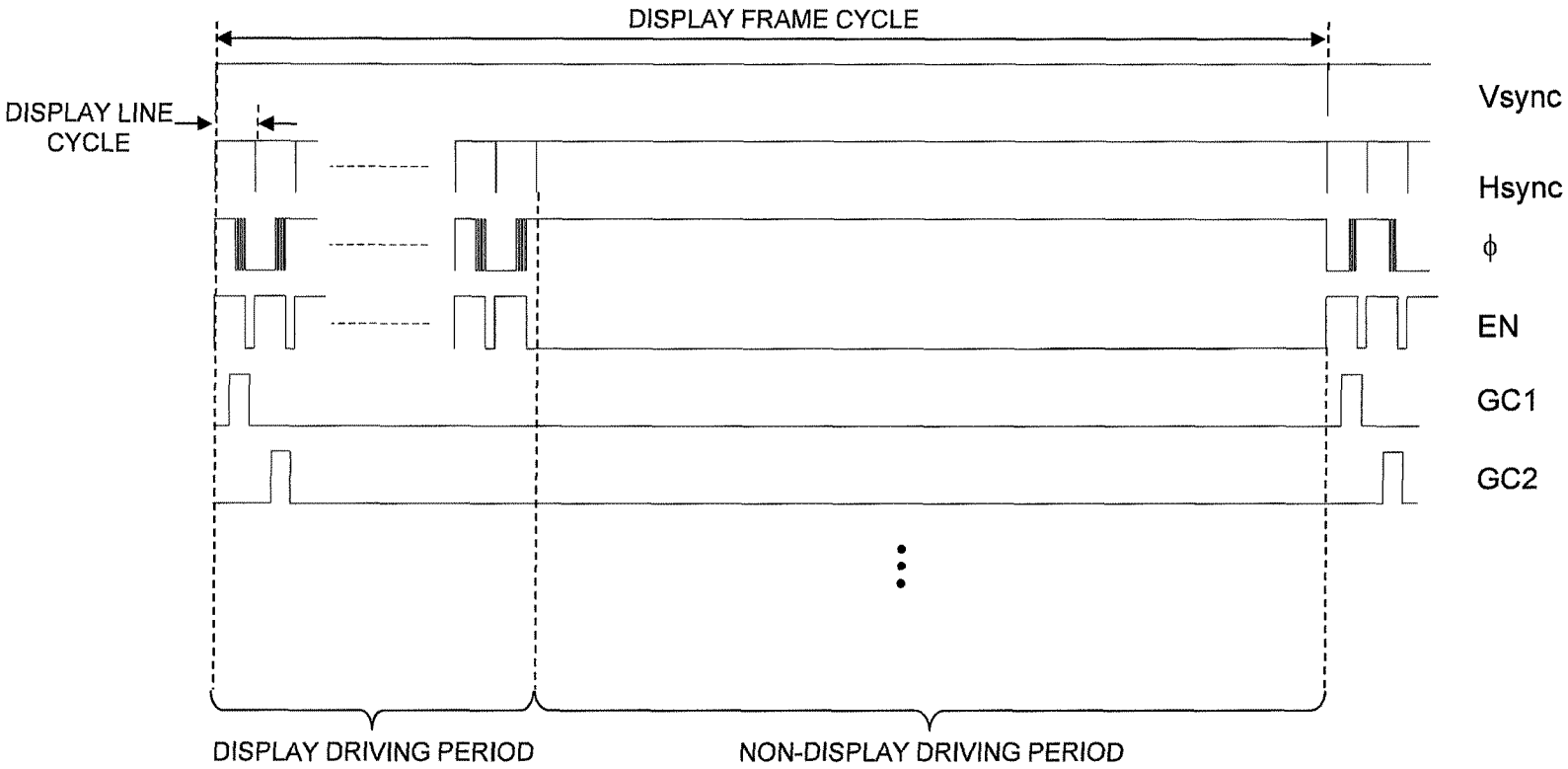
FIG. 5 is a timing diagram illustrating, in relation to a frame cycle, driving timing of a source electrode line according to a second chopping control aspect.
Figure 6:
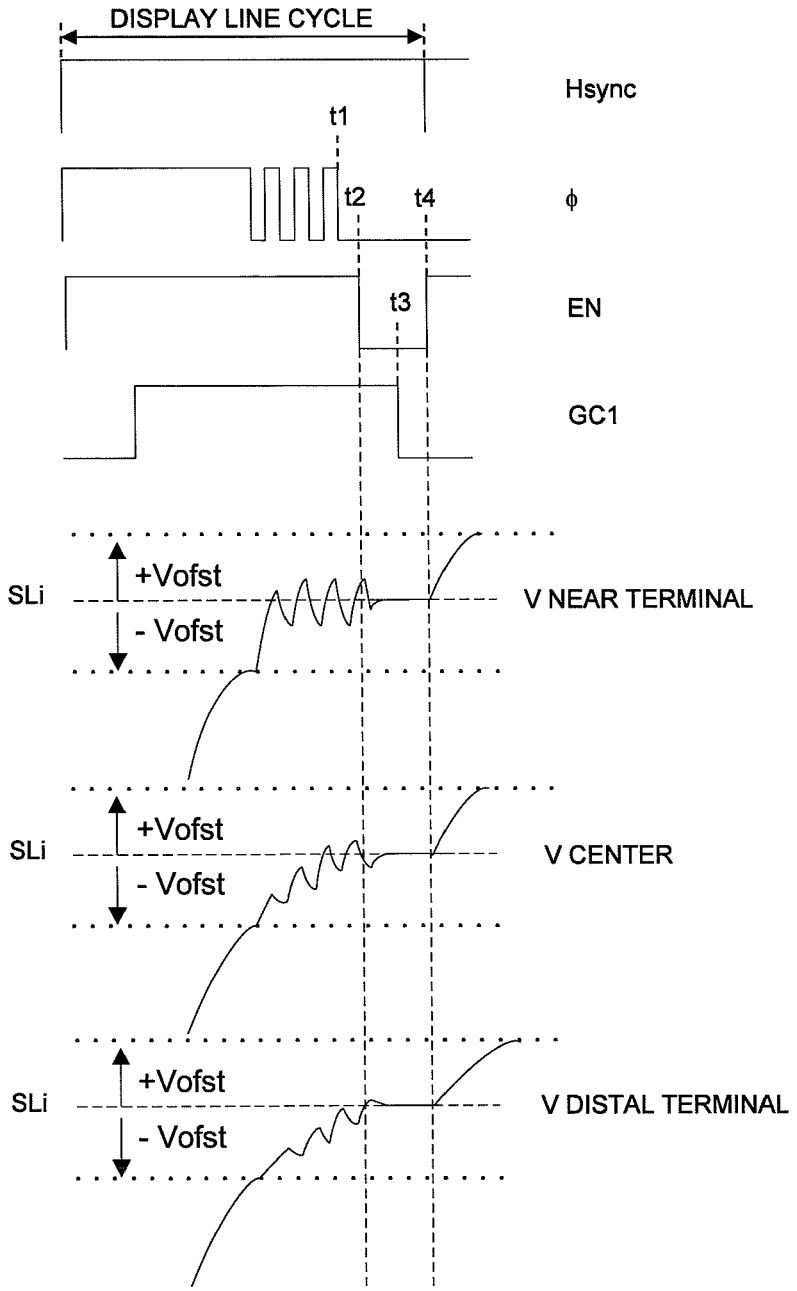
FIG. 6 is a waveform diagram illustrating, in relation to a display line cycle, driving timing and driving waveforms of a source electrode line according to a second chopping control aspect.

In FIG. 5, driving timing of the source electrode line according to a second chopping control aspect is illustrated in relation to the frame cycle. In FIG. 6, the driving timing and driving waveforms of the source electrode line according to a second chopping control aspect are illustrated in relation to the display line cycle.

In a case where the second chopping control aspect is employed, the control circuit 12 ends (time t1 in FIG. 6) the operation of alternately switching the polarities of the offset performed by the switch signal ϕ for each display line cycle, and then, performs a control which ends (time t3 in FIG. 6) the gate selection by floating (time t2 in FIG. 6) the output terminal of the source driving circuit 10. Here, the floating of the output terminal of the source driving circuit 10 is realized by making the enable signal EN input to the operational amplifier 20 to be in the low level thereby making the output of the operational amplifier 20 to be a high impedance.

As illustrated in FIG. 6, as the chopping waveform on the signal line SLi of the display panel 1 which is driven by the source driving circuit 10 by alternately switching the differential inputs drifts apart from the source driving circuit 10, the change of the chopping waveform becomes slow. By floating the output terminal 22 of the source driving circuit 10, the difference between the near terminal and the distal terminal of the signal line is averaged (times t3 to t4 in FIG. 6) by the charge share of the distributed capacitances of the signal line SLi, and in the full range from the near terminal to the distal terminal of the signal line SLi, the offset convergence becomes uniform. Moreover, the convergence of the offset also becomes fast by the charge share between the distributed capacitances of the signal line SLi. In the second chopping control aspect, it is possible to eliminate the concerns for the first chopping control aspect influencing the image quality due to the difference of the convergence of the offset at the near terminal and the distal terminal of the source electrode line SLi. Moreover, since a fast convergence of the offset due to the charge share can be expected, it is possible to reduce the period where the switch signal ϕ is clock-changed more quickly than that in the first chopping control aspect, and in this regard, it is possible to further contribute to the decrease of the power consumption.

In addition, since the selection of the pixel of the display line SLi is ended (time t3) after the floating is performed at a time t2, it is possible to guarantee that the brightness information charge-shared by the floating is maintained in the pixel capacitor Cpx.

Other points are the same as those in the first chopping control aspect, and thus, detailed description thereof will not be repeated.

<<Third Chopping Control Aspect>>

Figure 7:
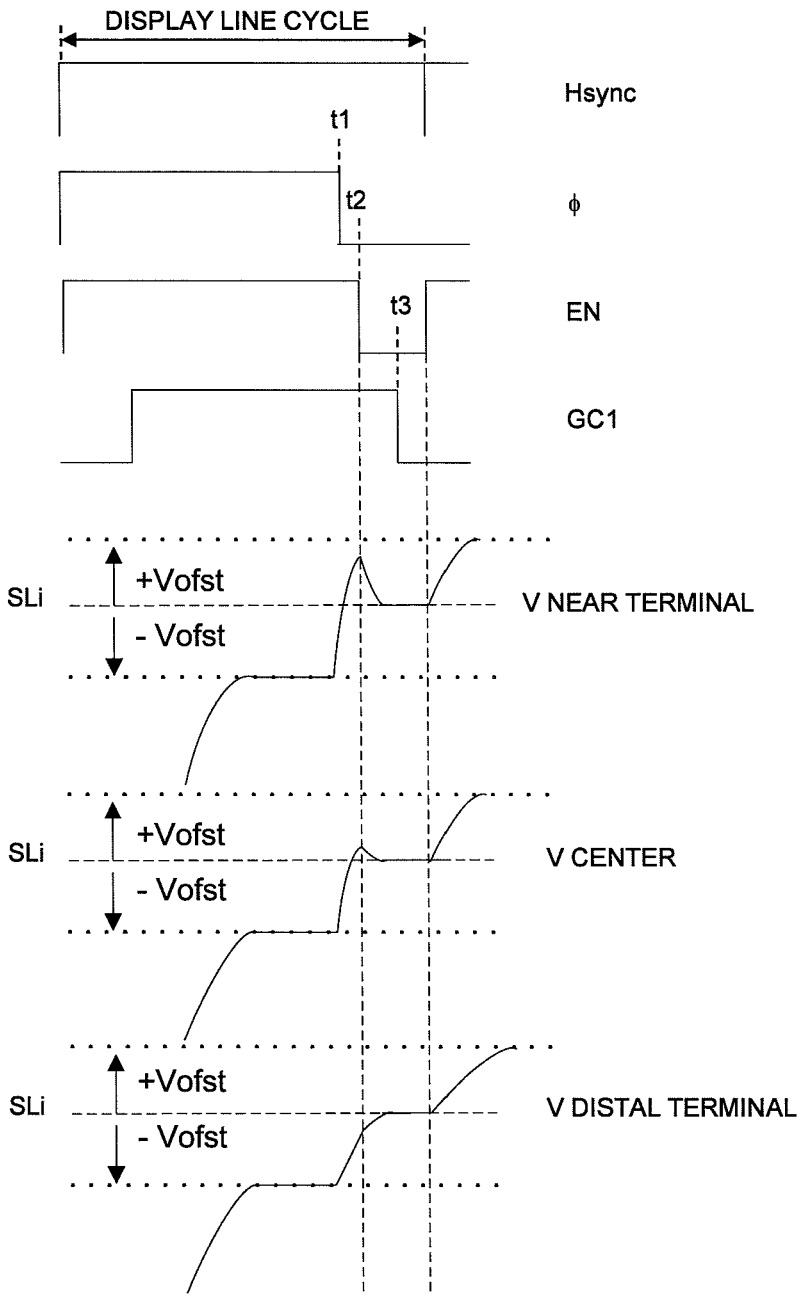
FIG. 7 is a timing diagram illustrating, in relation to a display line cycle, driving timing and driving waveforms of a source electrode line according to a third chopping control aspect.

In FIG. 7, driving timing and driving waveforms of the source electrode line according to a third chopping control aspect are illustrated in relation to the display line cycle. The third chopping control aspect is different from the second chopping control aspect in a point that the polarity switching of the offset performed by the switch signal ϕ is performed only one time for each display line cycle. That is, in a case where the third chopping control aspect is employed, the control circuit 12 divides one display frame into a display driving period and a non-display driving period, and performs a control which stops driving of the source driving circuit 10 during the non-display driving period, and causes the driving voltage used for the display to be output by switching the polarities of the offset appearing at the output of the source driving circuit 10, for each display line cycle which is the switching cycle of the display line during the display driving period. At this time, for each display line cycle, the polarities of the offset are switched (time t1), and thereafter, the control circuit ends (time t3) the selection of the pixel of the display line by floating (time t2) the output terminal 22 of the source driving circuit 10.

According to this, in the same manner as described above, in case that the polarities of the offset are switched for each display line cycle, the driving waveform on the signal line SLi has a difference at the near terminal and the distal terminal, but difference thereof is expedited so as to be averaged by the charge share of the distributed capacitances of the signal line SLi, by floating the output terminal 22 of the source driving circuit 10, and in the full range from the near terminal to the distal terminal of the signal line SLi, the converging offset effect can be obtained. However, in this case, the convergence of the offset is lower than that in the second chopping control aspect. In addition, since the selection of the pixel of the display line ends at the time t3 after the floating is performed at the time t2, it is possible to guarantee that the charge-shared brightness information is maintained at the pixel capacitor Cpx by the floating.

Other points are the same as those in the first chopping control aspect, and thus, detailed description thereof will not be repeated.

<<Chopping Operation>>

Figure 8:
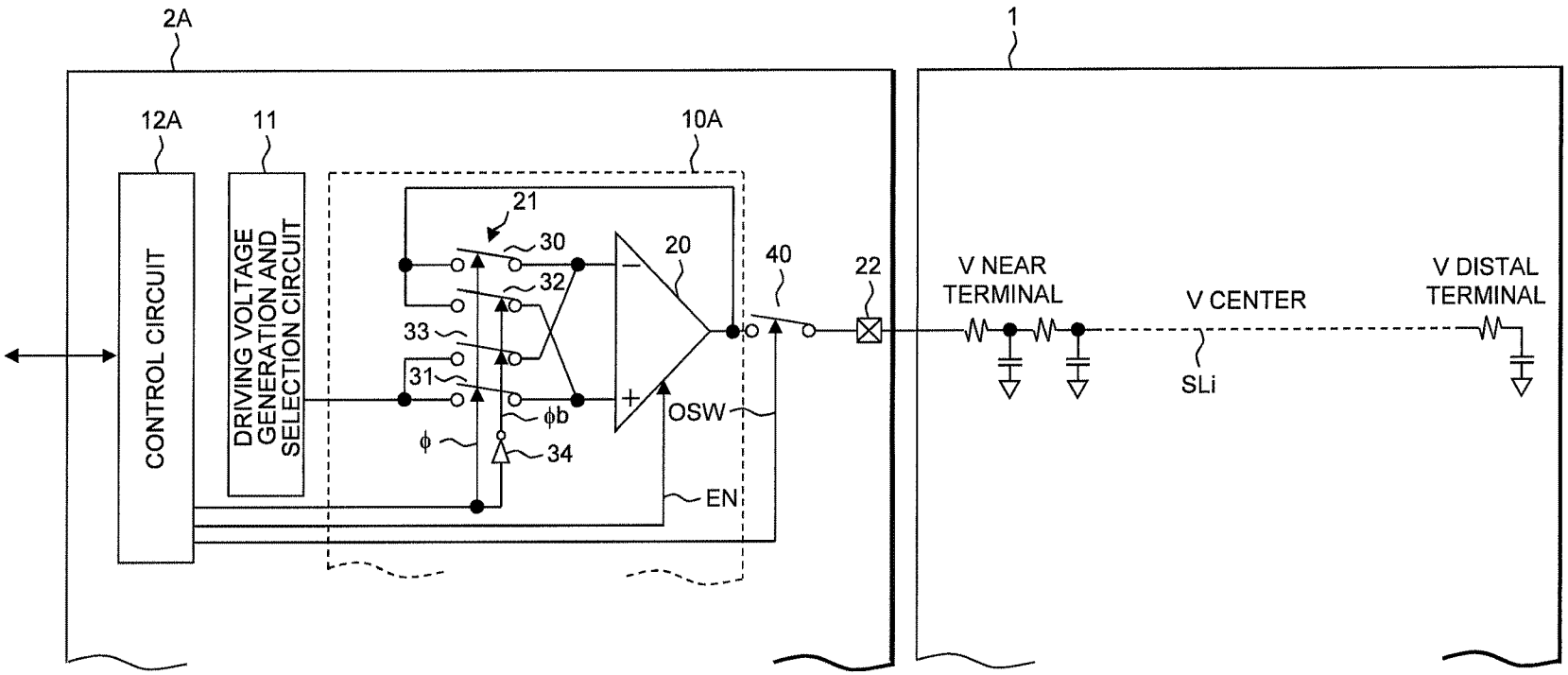
FIG. 8 is a block diagram exemplarily illustrating another configuration of performing a chopping operation of a source electrode line.

In FIG. 8, another configuration of performing the chopping operation of the source electrode line is exemplarily illustrated. Here, a configuration corresponding to one source electrode line SLi is representatively illustrated.

The driver IC 2A exemplarily illustrated in FIG. 8 is different from that in FIG. 1 in a point that a source driving circuit 10A is a unit in which the floating of the output terminal 22 is performed. That is, a transmission gate 40 is arranged between an output of the source driving circuit 10A and the output terminal 22, and a control circuit 12A performs a switch control of the transmission gate 40 using a gate switch signal OSW.

Other configurations are the same as those in FIG. 1, the same reference numerals are attached to the configuration elements having the same functions as those, and detailed description thereof will not be repeated.

Figure 9:
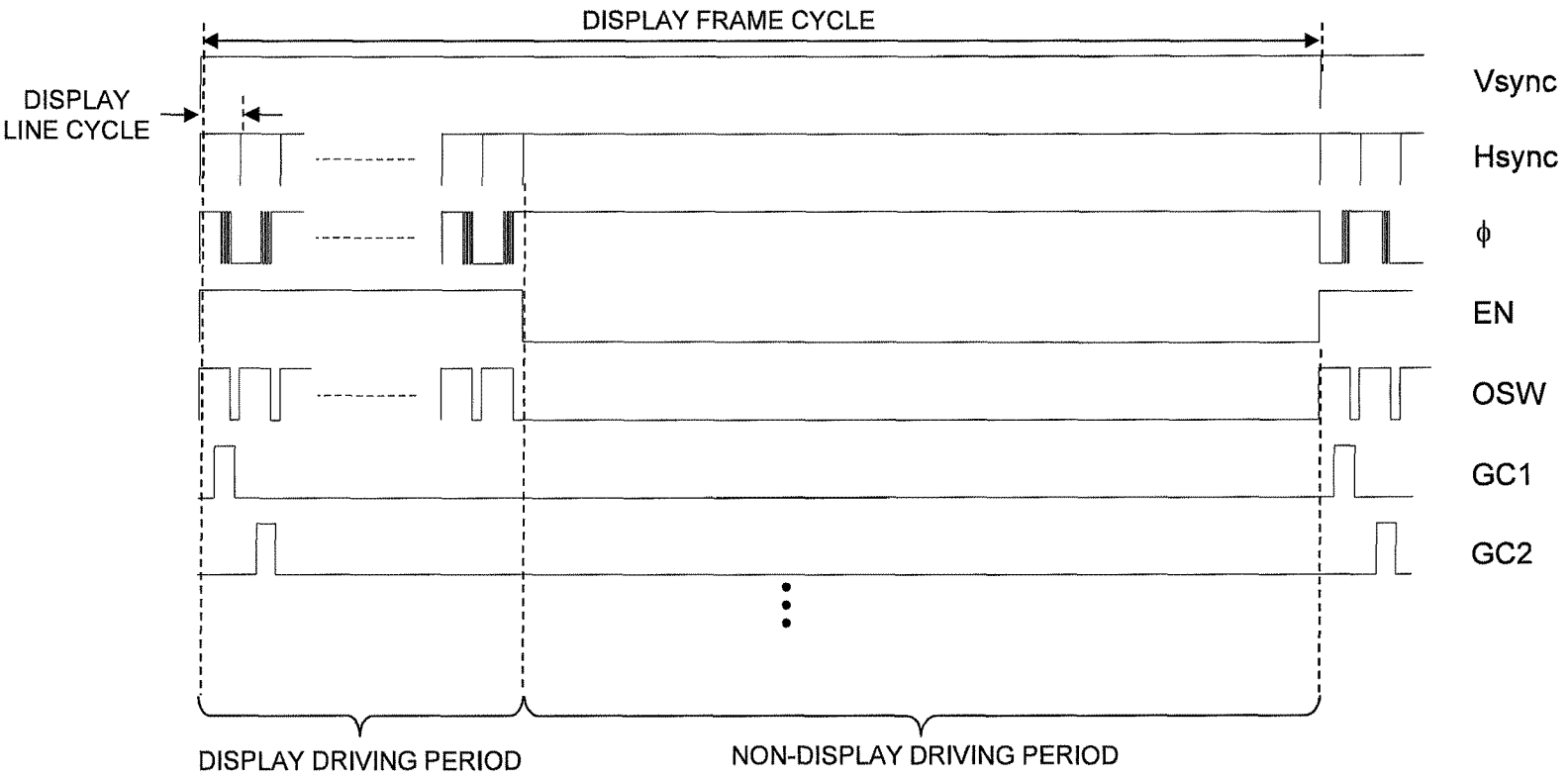
FIG. 9 is a timing diagram illustrating, in relation to a frame cycle, driving timing of a source electrode line according to a second chopping control aspect in the configuration of FIG. 8.
Figure 10:
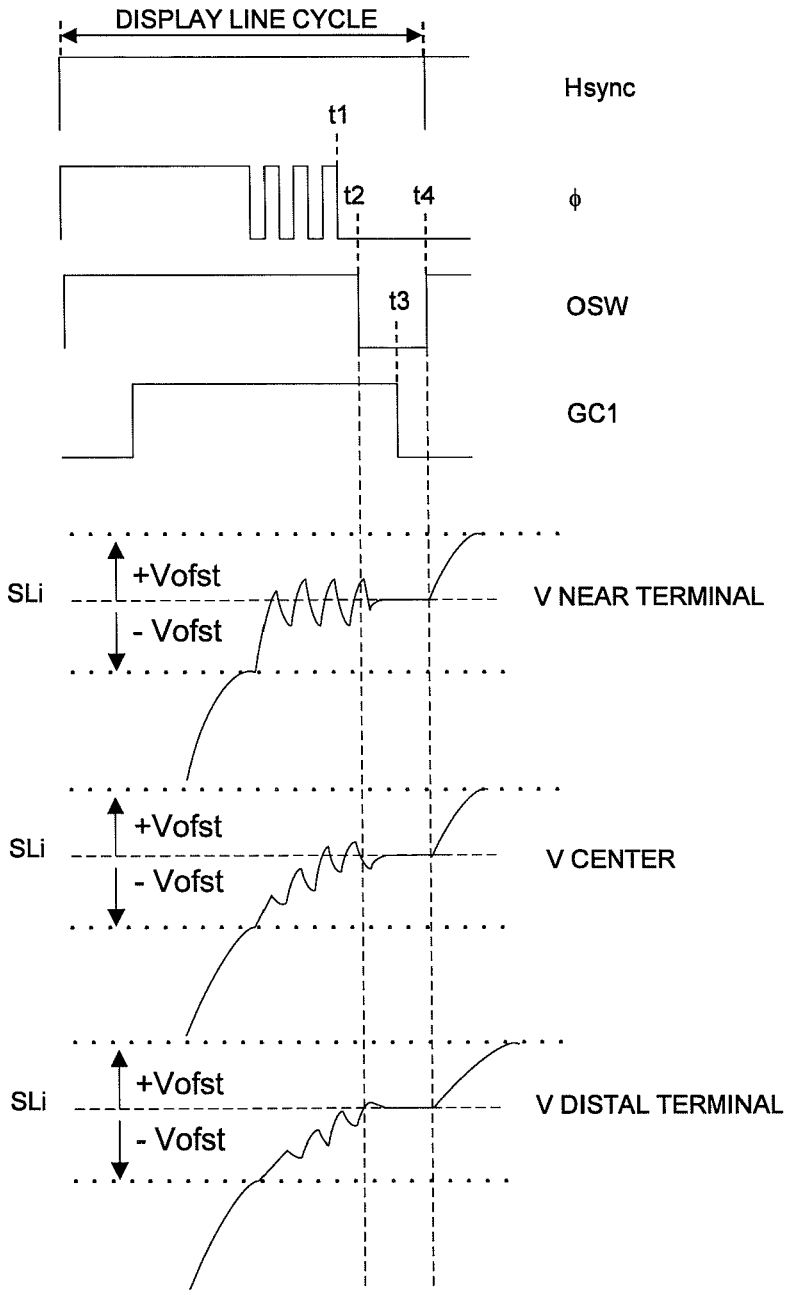
FIG. 10 is a waveform diagram illustrating, in relation to a display line cycle, driving timing and driving waveforms of a source electrode line according to a second chopping control aspect of FIG. 9.

In FIG. 9, driving timing of the source electrode line according to a second chopping control aspect in the configuration of FIG. 8 is illustrated in relation to the frame cycle. In FIG. 10, driving timing and driving waveforms of the source electrode line according to a second chopping control aspect of FIG. 9 are illustrated in relation to a display line cycle. FIG. 9 is different from FIG. 5 in a point that the enable signal EN is activated to a high level during the display driving period, and the floating of the output terminal 22 is realized by the transmission gate 40 being turned on or off. The driving waveforms of the source electrode line SLi illustrated in FIG. 10 are the same as those illustrated in FIG. 6.

It is considered that in a configuration of FIG. 8, the operational amplifier 20 is always activated to be able to operate during the display driving period, and thereby power consumption is increased by that amount, but tracking stability of the output to the input of the operational amplifier 20 during high speed driving is increased.

Although not particularly illustrated, even when the configuration in FIG. 8 is used, the fact that the driving of the source electrode line according to the first chopping control aspect can be performed is the same as that described with respect to FIG. 1, and thus, detailed description thereof will not be repeated.

Figure 11:
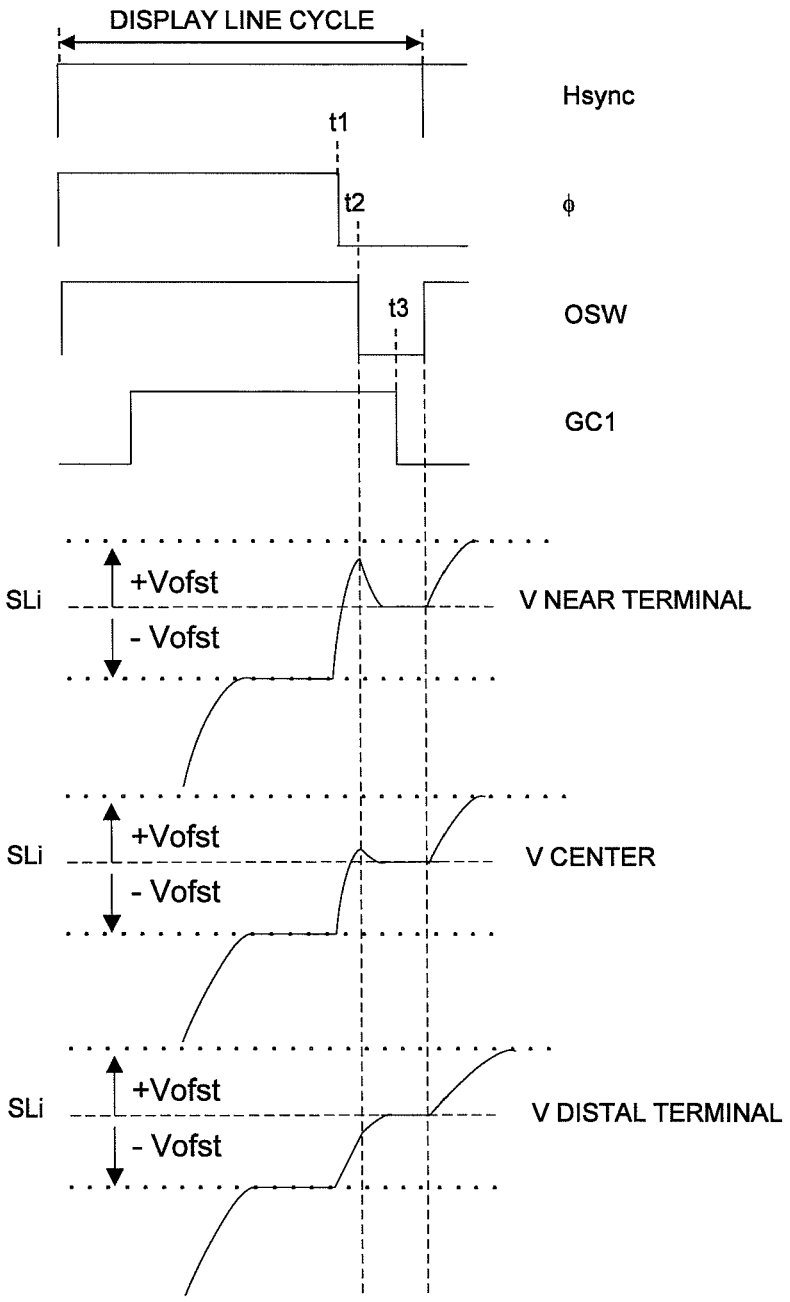
FIG. 11 is a waveform diagram illustrating, in relation to a display line cycle, driving timing and driving waveforms of the source electrode line according to a third chopping control aspect in the configuration of FIG. 8.

In FIG. 11, driving timing and driving waveforms of the source electrode line according to a third chopping control aspect in the configuration of FIG. 8 are illustrated in relation to the display line cycle. FIG. 11 is different from FIG. 7 in a point that the floating control of the source electrode line SLi is not performed by the enable signal EN, but by the gate switch signal OSW. The driving waveforms and the operation of the source electrode line SLi are the same as those in FIG. 7, and thus, detailed description thereof will not be repeated.

The present invention is not limited to the embodiments described above, and various changes may be made within a scope not departing from the gist thereof.

For example, the display panel is not limited to the liquid crystal panel, and may be an Electro-Luminescence (EL) panel. The display panel may be a panel module with a so-called in-cell shape in which the display panel 1 is combined with a touch panel. In this case, the panel module includes a TFT array substrate in which a TFT and a pixel electrode are arranged in a matrix on a glass substrate. A liquid crystal layer, a common electrode layer with respect to a pixel electrode, a color filter, a touch detection electrode, a surface glass, and the like are stacked on the TFT array substrate.

The gate driving may be performed by the driver IC 2, instead of the gate driver. The driver IC is not limited to a case where only a circuit for the liquid crystal driving is mounted, and further a touch panel controller, a sub-processor or the like may also be on-chip.

The configuration of alternately switching the inputs to a pair of differential input terminals of the driving circuit for a plurality of times between the gradation voltage and the reference voltage, is not limited to a case where the configuration is realized by a combination of the differential amplifier and the switch circuit, and can also be realized by the input and the output being switched by the output of the differential amplifier.

A unit that performs the floating of the output terminal of the driving circuit is not limited to a high output impedance of the amplifier and the switching control of the transmission gate, and can be appropriately changed.

In addition, the buffer amplifier is not limited to the voltage follower amplifier, and may be an inverting amplification circuit or a non-inverting amplification circuit.

What is claimed is:

1. A driver IC comprising:

a driving circuit which drives a display panel that has a plurality of pixels formed in a matrix, each said pixel being selected with a display line and supplied driving voltages through a plurality of source lines, wherein the driving circuit has a plurality of amplifiers each of which outputs the driving voltage to each of the source lines in parallel to the plurality of selected pixels, wherein an input to a pair of differential input terminals of the amplifier is alternately switched for a plurality of times between a gradation voltage and a reference voltage, for each display line cycle which is a switching cycle of a display line during a display period, wherein, during a first period from a time t2 to a time t3 after ending an alternate switching operation at a time t1 for each display line cycle, each output terminal of the amplifiers of the driving circuit is floated at a time t2 such that each individual source line connected to each corresponding output terminal holds the driving voltage present at the time t2 immediately prior to a beginning of the first period at the time t1 which was driven by one of said individual amplifiers, and wherein at the end of the first period and a beginning of a second period at the time t3, selection of a pixel in the display line ends.

2. The driver IC according to claim 1, wherein the differential input terminals are switched through which the gradation voltage and the reference voltage are applied to the driving circuit from the beginning, for each display line cycle.

3. A driver IC which drives a display panel that has a plurality of pixels formed in a matrix, each said pixel being selected with a display line and supplied driving voltages through a plurality of source lines, the driver IC comprising:

a voltage generation and selection circuit which generates a plurality of gradation voltages and selects a gradation voltage used for a display among the plurality of gradation voltages for each display line;

a driving circuit which has a plurality of amplifiers each of which outputs the driving voltage to each of the source lines in parallel to the plurality of selected pixels, and which outputs the driving voltage by inputting a reference voltage and the gradation voltage selected by the voltage generation and selection circuit to differential input terminals of each said amplifier; and a control circuit which controls an output operation of the driving circuit, wherein the control circuit divides one display frame into a display driving period which drives pixels of all display lines of one display frame and a non-display driving period which follows after the display driving period, and which stops driving of the driving circuit during the non-display driving period, and causes the driving circuit to output the driving voltage to selected pixels for each display line cycle which is a switching cycle of the display line during the display driving period, and at this time, a chopping operation of switching polarities of offset appearing at an output of the driving circuit within the display line cycle is performed for a plurality of times, and after ending the chopping operation at a time t1, an output terminal of the driving circuit is floated from a time t2 to a time t3, then selection of a pixel in the display line ends at the time t3.

4. The driver IC according to claim 3, wherein the chopping operation controls alternately switching inputs to a pair of differential input terminals of the driving circuit, in a cycle shorter than the display line cycle between the gradation voltage and the reference voltage.

5. The driver IC according to claim 4, wherein the control circuit performs control to switch the differential input terminals through which the gradation voltage and the reference voltage are applied to the driving circuit from a beginning time, for each display line cycle.

6. The driver IC according to claim 4, wherein the control circuit which floats the output terminal causes the output of the driving circuit to be a high impedance.

7. The driver IC according to claim 4, wherein the control circuit which floats the output terminal cuts off a transmission gate between the output of the driving circuit and the output terminal.

8. The driver IC according to claim 4, wherein the driving circuit includes a buffer amplifier configured from an operational amplifier which has the differential input terminals, and a switch circuit which alternately switches the gradation voltage and the reference voltage which are supplied to the differential input terminals.

9. The driver IC according to claim 8, wherein the buffer amplifier has an inverting input terminal and a non-inverting input terminal as the differential input terminals, and is a voltage follower amplifier in which a feedback signal of the output is set as a reference signal, and wherein the switch circuit is a switch circuit which alternately switches a signal supplied to the inverting input terminal and a signal supplied to the non-inverting input terminal between the feedback signal and the gradation voltage.

10. A driver IC which drives a display panel that has a plurality of pixels formed in a matrix, each said pixel being selected with a display line and supplied driving voltages through a plurality of source lines, the driver IC comprising:

a voltage generation and selection circuit which generates a plurality of gradation voltages and selects a gradation voltage used for a display among the plurality of gradation voltages for each display line;

a driving circuit which has a plurality of amplifiers which output driving voltages in parallel to the plurality of selected pixels, and each of which outputs a driving voltage by inputting a reference voltage and the gradation voltage selected by the voltage generation and selection circuit to differential input terminals of each said amplifier; and a control circuit which controls an output operation of the driving circuit, wherein the control circuit divides one display frame into a display driving period during which pixels of all display lines of one display frame are driven and a non-display driving period which follows after the display driving period, stops driving of the driving circuit during the non-display driving period, causes the driving voltage to the selected pixels by switching polarities of an offset appearing at an output of the driving circuit, for each display line cycle which is a switching cycle of the display line during the display driving period, and at this time, for each display line cycle, the polarities of the offset are switched, and thereafter, the control circuit floats output terminals of the amplifiers of the driving circuit, during a first period from a time t2 to a time t3, such that each source line holds the driving voltage present immediately prior to a beginning of the first period at a time t1 and which was driven by each individual amplifier, and subsequently at the end of the first period and a beginning of a second period at a time t3, ends selection of the pixel of the display line.

11. The driver IC according to claim 10, wherein the control circuit switches the differential input terminals through which the gradation voltage and the reference voltage are applied to the driving circuit from a beginning time, for each display line cycle.

12. The driver IC according to claim 10, wherein the control circuit which floats the output terminal causes the output of the driving circuit to be a high impedance.

13. The driver IC according to claim 12, wherein the control circuit which floats the output terminal cuts off a transmission gate between the output of the driving circuit and the output terminal.

* * * * *